US005209629A

United States Patent [19]

Rasmussen

[11] Patent Number: 5,209,629

[45] Date of Patent: May 11, 1993

[54] PILE-HANDLING APPARATUS

[75] Inventor: Ib H. Rasmussen, Hjortshoej, Denmark

[73] Assignee: Inframatic, Hjortshoej, Denmark

[21] Appl. No.: 678,306

[22] PCT Filed: Nov. 2, 1989

[86] PCT No.: PCT/DK89/00256

§ 371 Date: May 14, 1991

§ 102(e) Date: May 14, 1991

[87] PCT Pub. No.: WO90/05099

PCT Pub. Date: May 17, 1990

[30] Foreign Application Priority Data

Nov. 3, 1988 [DK] Denmark ..... 6119/88

[51] Int. Cl.[5] ..... B65H 15/02

[52] U.S. Cl. ..... 414/772; 414/774; 414/776; 414/728; 414/779; 414/783

[58] Field of Search ..... 414/728, 778, 779, 783, 414/761, 763, 772, 774, 776

[56] References Cited

U.S. PATENT DOCUMENTS

| | | | |
|---|---|---|---|
| 2,862,629 | 12/1958 | Aberle | 414/772 X |
| 3,063,575 | 11/1962 | Fontana | 414/776 |
| 3,174,631 | 3/1965 | Swihart et al. | 414/777 |
| 3,259,992 | 7/1966 | Bonwit et al. | 414/783 X |
| 3,670,903 | 6/1972 | Hamilton | 414/772 |
| 4,178,119 | 12/1979 | Busch | 414/783 X |

FOREIGN PATENT DOCUMENTS

| | | | |
|---|---|---|---|
| 108647 | 6/1984 | Japan | 414/772 |
| 62-12540 | 1/1987 | Japan | 414/783 |

*Primary Examiner*—Michael S. Huppert
*Assistant Examiner*—Janice Krizek
*Attorney, Agent, or Firm*—Watson, Cole, Grindle & Watson

[57] ABSTRACT

An apparatus for handling palletized piles of sheet-shaped materials including a first carriage having a fork tower with upper and lower forks which are actuated to grip the pile. The fork tower swings about a horizontal axis and rotates about a vertical axis. A second carriage has a pallet-supporting surface which rotates about a vertical axis. The first and second carriages are movable along rails so that a pile is aerated and positioned for delivery to a production machine.

3 Claims, 3 Drawing Sheets

PILE-HANDLING APPARATUS

BACKGROUND OF THE INVENTION

The present invention relates to an apparatus for handling palletized piles of sheet-shaped materials, especially by the admission or removal of the pile to or from a production machine, e.g. for printing, pressing or punching of the materials, which apparatus comprises means for controlling the functions of the apparatus, a fork tower having two sets of mutually movable forks for holding and inverting the pile and being swingable between a substantially vertical and a substantially horizontal position.

Today's production machines for handling sheets within the graphic arts industry are highly developed machines where the raw material, viz. sheets of paper or board, is fed to the machine as palletized sheet pile. Normally, the machines are provided with an automatic feeding device that permits the contents of the pallet to be used up without stopping the machine. When the feeding pallet, i.e., the pallet used in the admission of sheets, is empty, the machine is stopped and a new pallet is placed in position in relation to the feeding device of the machine. This involves a period of rearrangement which may typically be in the order of 10 minutes. However, most modern production machines are constructed so that they may continue the production substantially uninterrupted, provided a new palletized sheet pile is in position in relation to the feeding device and in a ready-to-use condition.

The following conditions have to be fulfilled before a palletized pile of sheets can be fed automatically into the production machine: the pallet should be oriented correctly so that the sheets are fed in the right direction, all the sheets should be piled uniformly oriented, all the sheets should be aerated immediately before admittance into the production machine, the pile should be aligned, the pile should be placed accurately in relation to the feeding device, and the pile should be provided with machine pallets or supporting plates which are designed specifically for the production machine.

U.S. Pat. No. 3,670,903 discloses an apparatus which makes it possible to fulfill some of these conditions in a manual and semi-automatic handling of the pile. The apparatus comprises a fork tower with two sets of mutually movable forks. The apparatus is intended for gripping a pile, inverting the same, and then in turn placing the pile upside down. Moreover, the apparatus comprises controlling means which consist of electrical buttons for energizing and deenergizing a motor effecting a tilting of the pile only. Thus an operator has to decide when to start and stop the motion of the movable part. Accordingly, this apparatus is associated with disadvantages as it necessitates time-consuming manual handlings between this apparatus and further auxiliary equipment which is necessary to prepare the pile for use in a production machine. Furthermore, stops in the supply to the production machine will also occur each time a new pile is to be inverted.

Similar handling problems exist when removing a palletized pile from a production machine. In principle the individual steps for removing the pile take place in reverse order as the pile which is produced at the outlet of a production machine most often has to go through a succeeding treatment and the steps up to and including the preparing of the pile for introduction into a following production machine may thus be substantially identical with the corresponding steps for the admission of a pile to the first production machine.

It is the object of the present invention to provide an apparatus wherein the above-mentioned drawbacks are remedied and which simultaneously enables a continuous accomplishment of the sequence of operations for preparing a pile and which simultaneously delivers the pile in a correct position and at the correct moment so that stops are eliminated.

SUMMARY OF THE INVENTION

This object is achieved with an apparatus according to the present invention which is characterized in that the apparatus comprises a first and a second carriage, that the controlling means are arranged for controlling the movable parts for supervising these movements and to start and stop the movements according to a selected sequense, that the first carriage comprises means for conditioning the pile and a frame for a fork tower, and that the second carriage comprises a frame for a pallet-supporting surface that may be rotated about a vertical shaft and which is connected with means for displacement of the shaft and with it the pallet-supporting surface in relation to the frame of the second carriage in a substantially horizontal plane. An automatic accomplishment of the handling of the pile is hereby achieved. In the following this handling will be explained in connection with admission to a production machine. The palletized sheet pile arrives either by means of a truck or via a conveyor system which places the pallet in such a position that it can be caught by the forks on the first carriage which is placed furthest from the production machine wherein the sheets are to be treated. The pallet and the pile placed on it are caught by a set of mutually movable forks, a lower set lifting the pallet clear of its support while an upper set of forks are brought into contact with the top side of the pile thus retaining same. Then the pile may be tilted from its vertical position to a substantially horizontal position so that the sheets now stand upright. Then it is possible to loosen the hold of the forks on the pile, optionally after setting the pile in a slightly oblique position, whereby the sheets, e.g. in connection with an aerating or vibration, are brought into contact with the fork tower and hereby the pile is aligned. Simultaneously, it becomes possible to remove the transport pallet if it should be replaced by a machine pallet which is adapted to the production machine to be fed.

After conditioning and alignment of the pallet, the fork tower is tilted back to its vertical position and the pile which is now supported by a machine pallet is placed on a pallet-supporting surface on the second carriage. The second carriage is placed in a position between the first carriage and the feeding device of the production machine. Furthermore, the two carriages are controlled mutually and in relation to the production machine by means of any controlling means, e.g., a rail arrangement or by wires placed in the floor. The pallet-supporting surface of the second carriage and the pile placed on it may subsequently be rotated about the vertical shaft to place the aligned side of the pile correctly in relation to the production machine, and then the carriage conveys the pile into the feeding device of the production machine. The means for displacement of the shaft and the pallet-supporting surface enable a completely accurate positioning of the pile in relation to the feeding device as the pile may be displaced transversely in relation to the movement direction of the second carriage.

The pile which now is in its proper place may in a manner known per se be brought into contact with the last sheets in the preceeding pile in that supporting tubes permitting removal of the pallet are inserted into the preceeding machine pallet. After removal of the machine pallet, the supporting tube may also be removed. The supporting tubes for use in the positioning of the pile into contact with the preceeding pile are known and are not part of the present invention.

Simultaneously with the second carriage positioning a pile in relation to the feeding device, a new pile may be handled by the first carriage. Thus, a continuous admission to the production machine may be obtained without stops.

The described apparatus makes it possible to handle palletized sheet piles through a number of production machines by means of flexible manufacturing system (FMS) plants.

DESCRIPTION OF THE DRAWING

The invention will now be described in further detail with reference to the accompanying drawings wherein.

DETAILED DESCRIPTION OF THE PREFERRED EMBODIMENT

Figure 1:
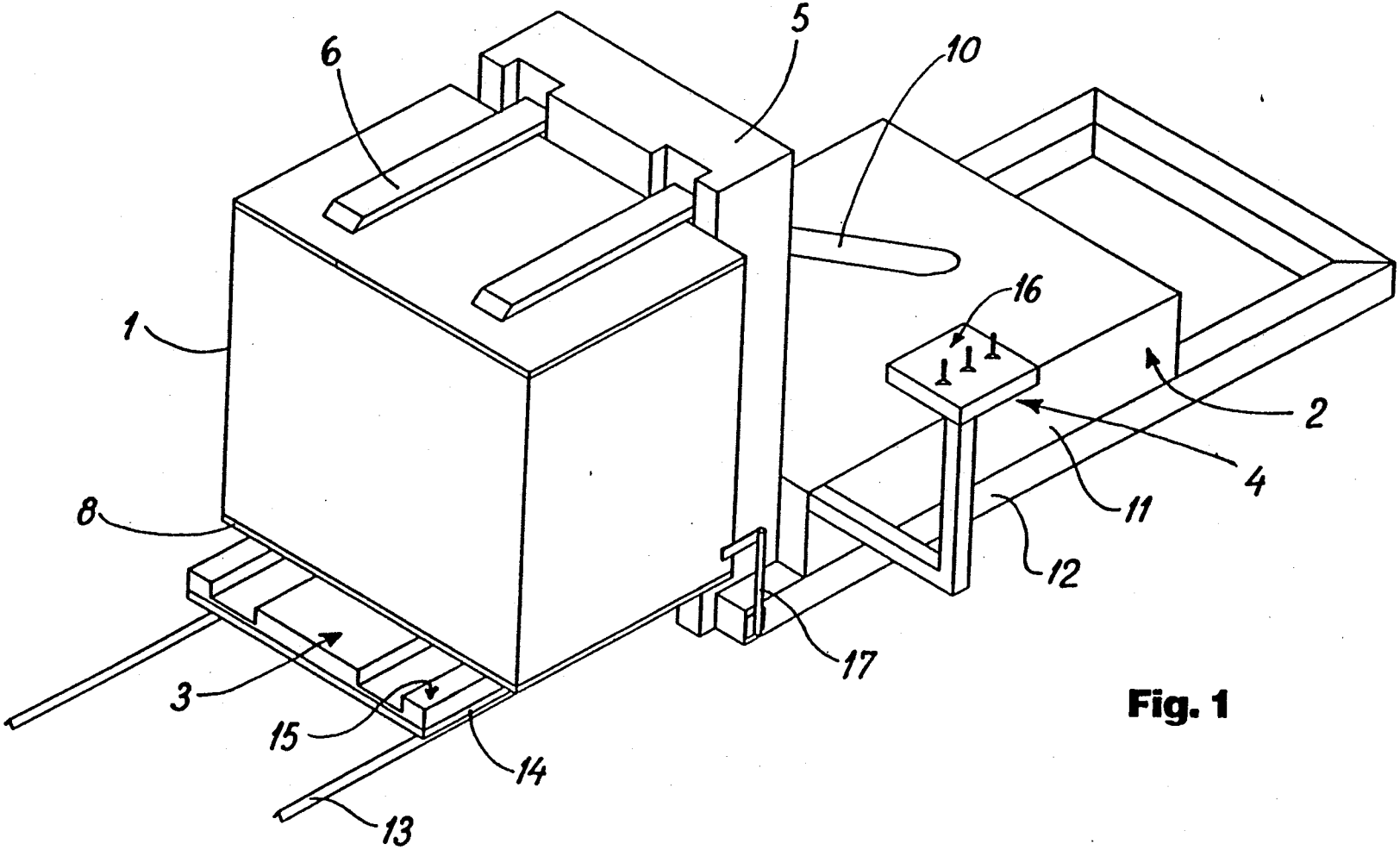
FIG. 1 is a partial view of an apparatus according to the invention.
Figure 2:
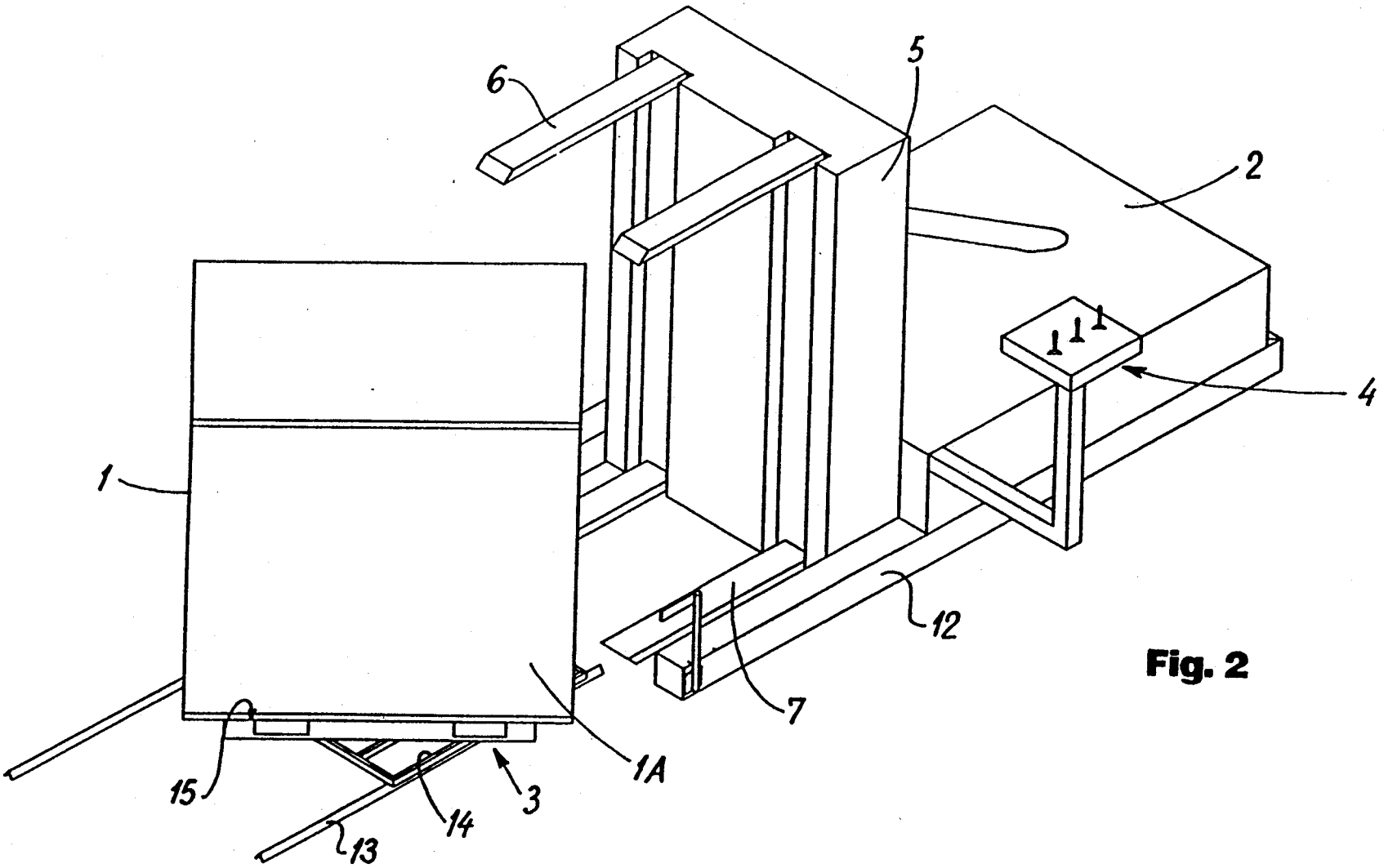
FIG. 2 is a view corresponding to the one shown in FIG. 1, but with the two carriages in another position.

FIGS. 1 and 2 show an apparatus for handling a palletized pile 1 of sheet-shaped materials. The sheet-shaped materials may be made from paper, cardboard, corrugated paper, plastic, metal or combined laminates.

Figure 6:
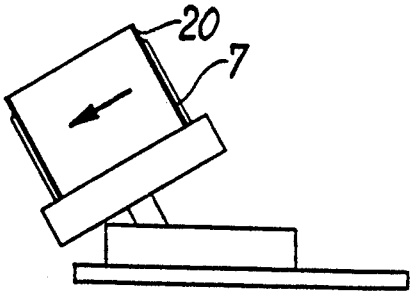
Figure 7:
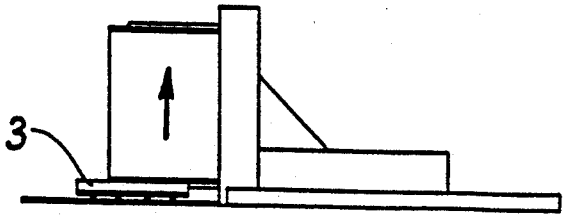
Figure 8:
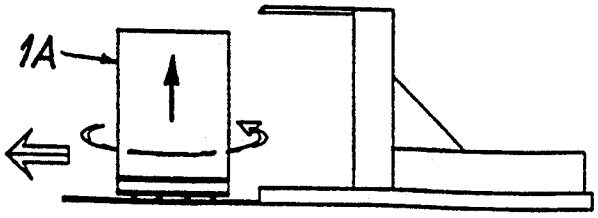

The apparatus illustrated is intended for use in the admission of a pile 1 to a production machine (not shown) within the graphic arts industry, e.g., for printing, pressing or punching of the sheet-shaped materials. The apparatus comprises a first carriage 2, a second carriage 3 and means 4 for controlling the functions of the apparatus. The first carriage 2 comprises a fork tower 5 with an upper pair of forks 6 and a lower pair of forks 7. The two pairs of forks 6 and 7 are mutually movable so as to grip the pile 1 which is placed on a pallet 8 (either a transport pallet (18, see FIG. 3) or a pallet (20, see FIG. 6) adapted to the actual production machine). The fork tower is provided with means for conditioning the pile in the form of air nozzles placed in the plane of the fork tower and intended for aeration of the sheets immediately before the introduction into the production machine. The air nozzles may be connected with a supply of ionized air or they may be provided with atmospheric air. The air nozzles are arranged to aerate the pile when provided in a substantially horizontal position with the sheets standing upright and with the forks moved apart.

Figure 5:
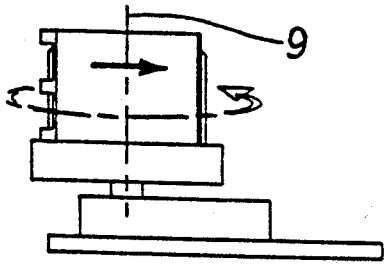

The fork tower 5 is arranged so that it may swing between a vertical position (shown in FIGS. 1 and 2) and a horizontal position (shown in FIG. 5). Furthermore, the fork tower is arranged for rotation about an axis 9 (see FIG. 5) extending substantially perpendicularly to the pile 1. In the shown embodiment the fork tower 5 is swung between its two positions by means of a jack 10 connected to the frame 11 of the carriage 2 and the fork tower 5.

In the embodiment the two carriages 2 and 3 drive on rails 12 and 13, respectively. However, the rails 12 and 13 may also be provided as one pair of rails for both carriages. The second carriage 3 comprises a frame 14. The frame 14 supports a pallet-supporting surface 15 which is rotatable about a vertical shaft and the pile, in FIG. 2, is shown as rotated in relation to the position shown in FIG. 1. By this rotation of the pallet-supporting surface 15 and the pile 1 placed on it, it becomes possible to place the side 1*a* of the pile which has been in contact with the fork tower and which is aligned in contact with a succeeding production machine.

The shaft may be displaced in relation to the frame 14 as it is borne in an oblong opening (not shown) in the frame and is connected with an operating rod (not shown) which may be activated manually or mechanically. Hereby the supporting surface 14 and the pile placed on it may be displaced transversely to the movement direction of the carriage lengthwise of the rails 13 for a completely accurate positioning of the pile 1 in relation to the feeding device of the production machine (not shown). The pallet-supporting surface 15 is preferably supported by a ball-equipped support (not shown) connected to the frame 14 and which enables both the rotation and translation of the pallet-supporting surface 15 in relation to the frame 14.

The control means 4 comprise the rails 12,13 guiding the movement of the carriage, different position sensors and a control desk 16 with controls for the driving means for the different individual parts of the apparatus. The control means may also comprise a computer controlling the functions of the apparatus in a desired sequence.

FIG. 3–8 illustrate the cycle of operations in handling a pile 1 placed at the apparatus, e.g. by means of a truck, and which pile is to be introduced into the production machine. The pile 1 is placed against a position sensor 17 (see FIG. 1) emitting a signal for the correct positioning of the pile in relation to the apparatus. The pile 1 is supported on a transport pallet 18 and the top side of the pile is protected by a plate 19. The first carriage 2 moves forward lengthwise of the rail 12 with the forks wide open whereby the lowest pair of forks 7 slides under the pallet 18 while the upper pair of forks 6 slides over the top of the pile 1 and the plate 19. The forks 6,7 are moved towards one another embracing the pile (see FIG. 4). The pile is then lifted clear of the support, whereafter it is turned to a substantially horizontal position (see FIG. 5). In this position the forks rotate about the axis 9 extending substantially perpendicularly to the pile 1. In this position the grasp of the forks 6,7 on the pile may be released, but the fork tower may also be turned back towards the vertical position about 30° whereby it becomes possible to remove the transport pallet 18 and replace this with a machine pallet 20 (see FIG. 6). In this position the pile may also be aerated. However, the pile is normally aerated in the horizontal position.

Figure 3:
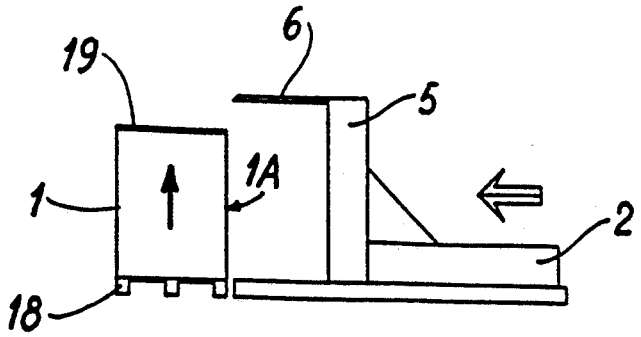
FIG. 3–8 are scematic views for illustration of the mode of operation of the apparatus.
Figure 4:
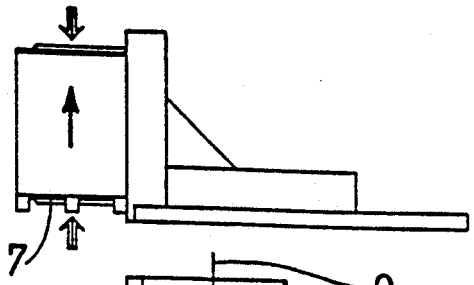

The pile 1 is again rotated 180° and the fork tower is turned to its substantially vertical position whereby the pile may be placed on the second carriage 3 which in the meantime, has been driven into position. The forks 6,7 are opened and deliver the pile 1 on this second carriage. The pile is rotated on the second carriage 180° about the vertical axis of the pallet-supporting surface 15 so that the side 1*a* of the pile which was placed and previously aligned against the fork tower 5 is now directed towards the production machine. Then the second carriage carries the conditioned and aligned pile towards the production machine (not shown) where a final complete adjustment is performed by means of the above-mentioned means enabling a displacement of the pallet transversely to the rails. Simultaneously with the pile being delivered to the feeding device of the production machine, a new pile may be placed in the apparatus as illustrated in FIG. 3.

It is noted that the first carriage 2 may be utilized only for inverting the pile without performing a conditioning.

I claim:

1. An apparatus for aligning an adjacent side edge of a plurality of sheet-shaped materials positioned in a pile on a pallet and for thereafter conveying the pile to a production machine, said apparatus comprising:

a first carriage which includes a first frame that is movable along tracks, a fork tower which mounts upper and lower forks that are movable towards and away from each other so as to grip or release a pile of sheet-shaped materials positioned on a pallet, and means connecting said fork tower to said first frame to move said fork tower between a vertical orientation and a horizontal orientation and to cause said fork tower to rotate around a first vertical axis when horizontally oriented, a second carriage which is movable along tracks and which includes a second frame and a pallet-supporting surface which is movably mounted on said second frame so as to be rotatable about a second vertical axis and horizontally movable relative to said second frame, and control means for controlling said first and second carriages, said control means including tracks along which said first and second frames are movable, said control means causing (1) said first frame to move along said tracks with said fork tower vertically oriented so that said upper and lower forks can grip a pile of sheet-like materials positioned on a pallet, (2) said fork tower to reorient into a substantially horizontal orientation, (3) the grip of said upper and lower forks to loosen on said pile of sheet-like materials and pallet and said fork tower to rotate about said first vertical axis so that an adjacent side edge of each of said plurality of sheet-like materials moves against said fork tower and become aligned with each other, (4) the grip of said upper and lower forks to tighten on said aligned sheet-like materials in said pile and pallet, (5) said second carriage to move along tracks to a pick-up position, (6) said fork tower to reorient into a vertical position such that said pile of aligned sheet-like materials and pallet are deposited on said pallet-supporting surface of said second carriage at said pick-up position, (7) said pallet-supporting surface to rotate around said second vertical axis and to move horizontally relative to said second frame, and (8) said second carriage to move along said tracks away from said first carriage and towards said production machine such that the aligned adjacent side edge of each of said plurality of sheet-like materials faces said production machine.

2. An apparatus according to claim 1, wherein said control means includes a position sensor which emits a signal when a pile of sheet-like materials on a pallet is located for gripping by the upper and lower forks of said first carriage.

3. An apparatus according to claim 1, wherein said control means includes a first set of tracks on which said first carriage moves and a second set of tracks on which said second carriage moves.

* * * * *